United States Patent [19]

Seeley

[11] 4,171,525

[45] Oct. 16, 1979

[54] VLF LOOP ARRAY ANTENNA

[75] Inventor: Elwin W. Seeley, San Diego, Calif.

[73] Assignee: The United States of America as represented by the Secretary of the Navy, Washington, D.C.

[21] Appl. No.: 893,548

[22] Filed: Apr. 5, 1978

[51] Int. Cl.[2] ..... H01Q 3/36

[52] U.S. Cl. ..... 343/853; 343/728; 343/742; 343/844

[58] Field of Search ..... 343/844, 853-855, 343/726, 728, 741, 742, 748

[56] References Cited

U.S. PATENT DOCUMENTS 3,396,398 8/1968 Dunlavy, Jr. ..... 343/844

3,478,269 11/1969 Enemark et al. ..... 343/855

*Primary Examiner*—David K. Moore

*Attorney, Agent, or Firm*—R. S. Sciascia; G. J. Rubens; T. M. Phillips

[57] ABSTRACT

A directional loop array antenna for very low frequency (VLF) reception. The array comprises four closely spaced loop antennas forming a unidirectional reception pattern with a main beam of less than 43° between half power points. The array combines two double loop coaxial antennas dispersed with their axis parallel along 45° lines. The signal from one double loop array is delayed sufficiently such that a unidirectional reception pattern is formed.

5 Claims, 5 Drawing Figures

VERTICAL SCALE ALONG 0° AXIS
IS VOLTAGE COMPARED TO ONE LOOP.

VLF LOOP ARRAY ANTENNA

BACKGROUND OF THE INVENTION

It is very difficult to obtain high directivity at very low frequencies (below 30 Khz). Conventional antenna arrays at these long wavelengths must be many miles. Some VLF receiving stations aboard ships now use whip antennas which receive natural atmospheric noise equally from all directions and cannot discriminate against these noise sources.

SUMMARY OF THE INVENTION

The present invention provides an antenna array which forms a narrow reception beam by combining the signals from two 2-loop arrays. The signal from one 2-loop array is delayed ($\delta$) in order to form the unidirectional reception pattern. The antenna system will receive desired signals within a 43° main beam and will reject atmospheric noise at azimuthal angles outside the 43° beamwidths.

Accordingly, an object of the invention is the provision of an antenna for receiving very low frequency communication signals having a narrow reception beamwidth with a very small antenna whose dimensions are a small fraction of a wavelength.

Another object is to provide an antenna system which will receive very low frequency communication signals, discriminating against natural atmospheric noise resulting in improved signal to noise ratio and an increase in communication coverage and reduce error rates.

Other objects and many of the attendant advantages of this invention will be readily appreciated as the same becomes better understood by reference to the following detailed description when considered in connection with the accompanying drawings.

DESCRIPTION OF THE PREFERRED EMBODIMENT

Figure 1:
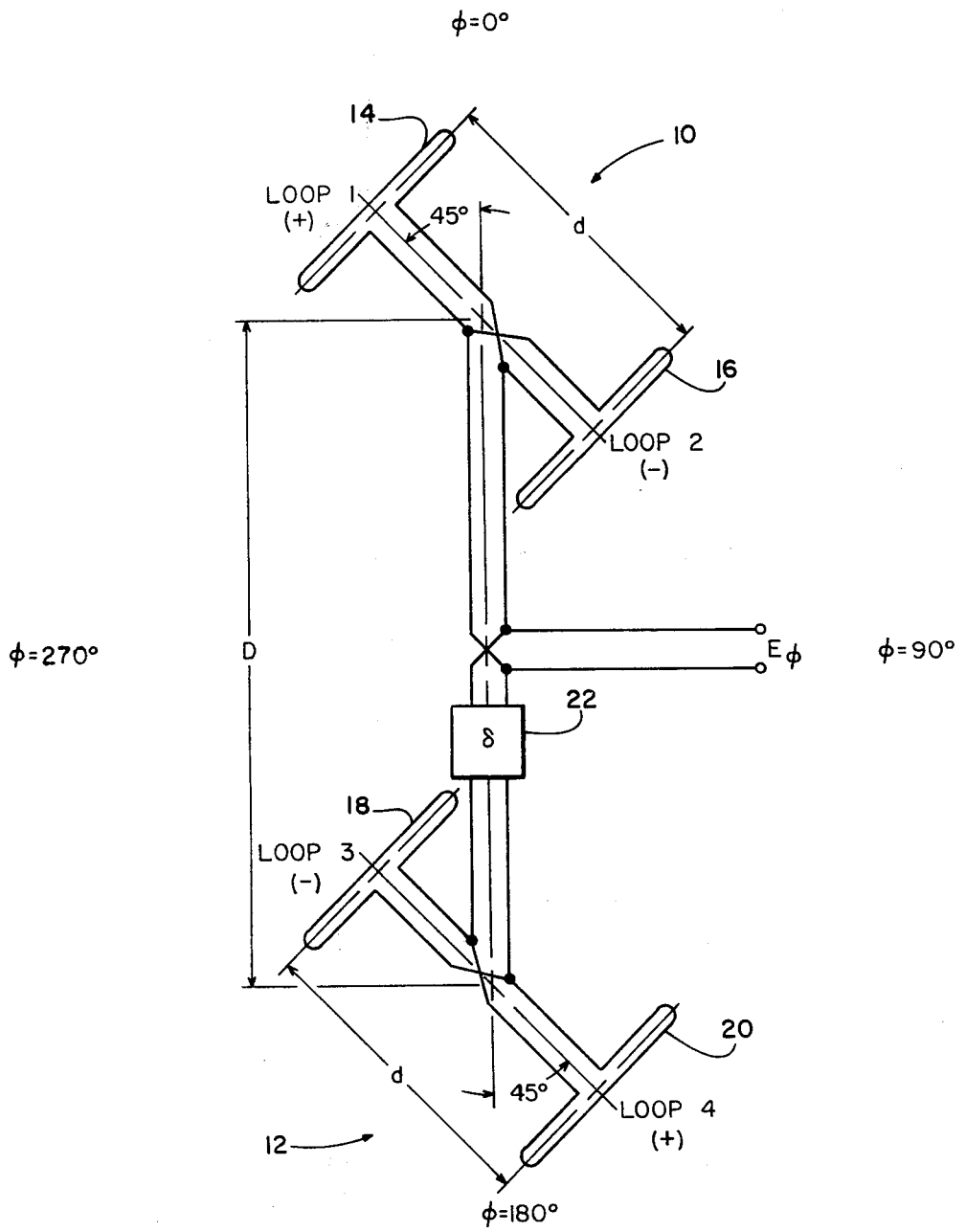
FIG. 1 is a schematic diagram of the antenna array which embodies the invention.

Referring now to the drawings wherein there is shown in FIG. 1, two 2-loop arrays 10 and 12, respectively. Array 10 comprises coaxial loops 14 and 16 dispersed with their axis parallel along 45° lines with respect to the earth surface (or ground plane). Loops 14 and 16 are separated by a distance, d. Array 12 comprises coaxial loops 18 and 20 dispersed with their axis parallel to the loops 14 and 16 of array 10. Loops 14 and 16 are connected so they are 180° out-of-phase. Loops 18 and 20 are also connected so they are 180° out-of-phase. The received signal from loops 18 and 20 is delayed by an amount, $\delta$, by means of a delay line 22. The amount of delay, $\delta$, should be selected, depending on where the null position, $\phi_0$, is desired to exclude unwanted signals.

In order to better understand the invention, equations describing the horizontal pattern of pairs of vertical coaxial loops are derived. These coaxial loop pairs are then combined to form superdirective arrays as shown in FIG. 1.

When two identical loops are oriented in a horizontal and parallel plane and 180° out-of-phase, the vertically polarized received voltage is the sum of the two loop voltages.

$$E_\phi = \sin\phi\left[e^{j\frac{\pi d}{\lambda}\cos\phi} - e^{-j\frac{\pi d}{\lambda}\cos\phi}\right] \tag{1}$$

which reduces to $$E_\phi = 2\sin\phi\sin\left[\frac{\pi d}{\lambda}\cos\phi\right] \tag{2}$$

and for small loop spacings much less than a wavelength $$E_\phi = (2\pi d/\lambda)\sin\phi\cos\phi$$

which reduces to $$E_\phi = (\pi d/\lambda)\sin 2\phi \tag{3}$$

where d = distance between loops $\lambda$ = wavelength $\phi$ = angle in the horizontal plane If equation (3) were plotted it would show that the pattern of a pair of coaxial loops for four symmetrical beams each of which has a half-power beamwidth of 45°. If two pairs of these coaxial loops tilted at 45° are combined into a superdirective array as in FIG. 1, a pattern with only one narrow main lobe and four side lobes can be obtained. The pattern equation of the individual pair tilted 45° is $$E_\phi = (\pi d/\lambda)\sin 2(\phi - 45°)$$

which reduces to $$E_\phi = (\pi d/\lambda)\cos 2\phi \tag{4}$$

By pattern multiplication the pattern equation of the superdirective array in FIG. 1 is then $$E_\phi = \frac{\pi d}{\lambda}\cos 2\phi\left[\frac{2\pi d}{\lambda}(\cos\phi - \cos\phi_0)\right] \tag{5}$$

where the individual pairs of coaxial loops are 180° out-of-phase and

D = distance between pairs of coaxial loops $\phi_0$ = null position is determined by amount of delay.

When the distance between loops, d, equals the distance, D, between pairs of coaxial loops and both are much less than a wavelength, equation (5) reduces to $$E_\phi = 2(\pi d/\lambda)^2\cos 2\phi(\cos\phi - \cos\phi_0) \tag{6}$$

Important pattern characteristics such as the position and amplitude of the side an back lobes and the beamwidth can now be derived from equation (6). Equations for these characteristics are derived as a function of the null position which is moved around to exclude unwanted signals by inserting the delay 22 in one side of the array.

The positions of the side lobes may be located by differentiating equation (6) and equating the differential to zero. The results are $$\sin \phi = 0 \tag{7}$$

and $$\text{Cos } \phi = \tfrac{1}{3} \cos \phi_0 \pm \tfrac{1}{3}\sqrt{\cos^2 \phi_0 = 3/2} \tag{8}$$

Figure 2:
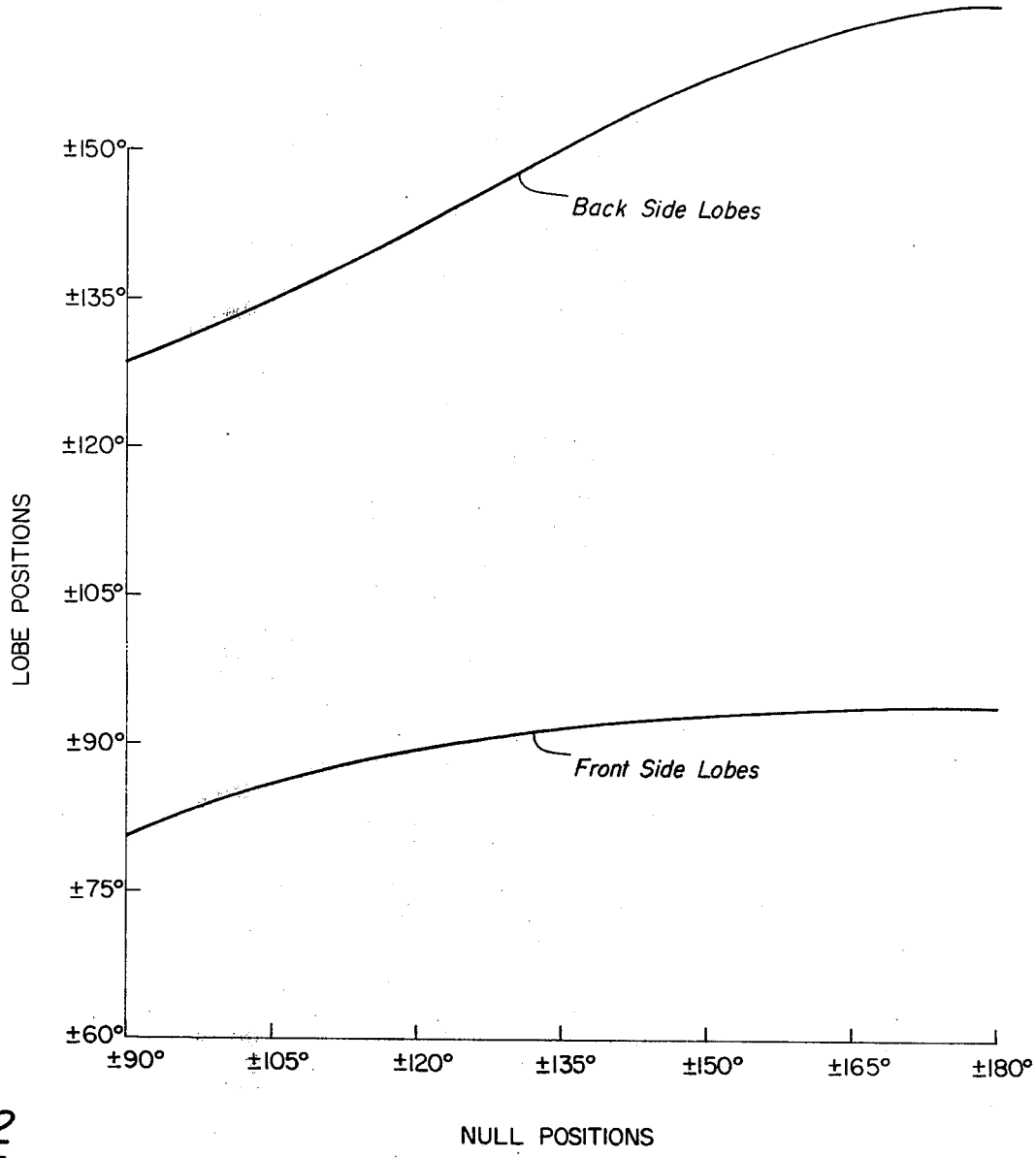
FIG. 2 is a plot of front and back side lobes with respect to null position.
Figure 4:
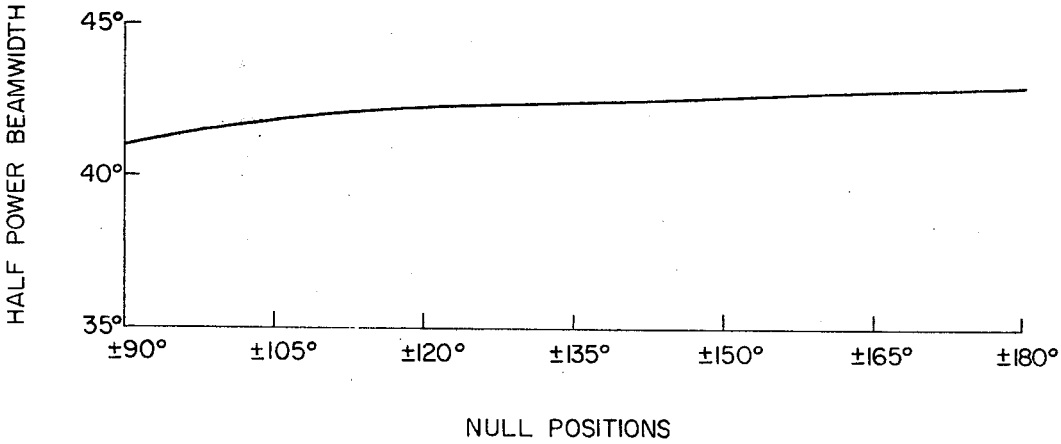
FIG. 4 is a plot of half power beamwidth with respect to null position.
Figure 3:
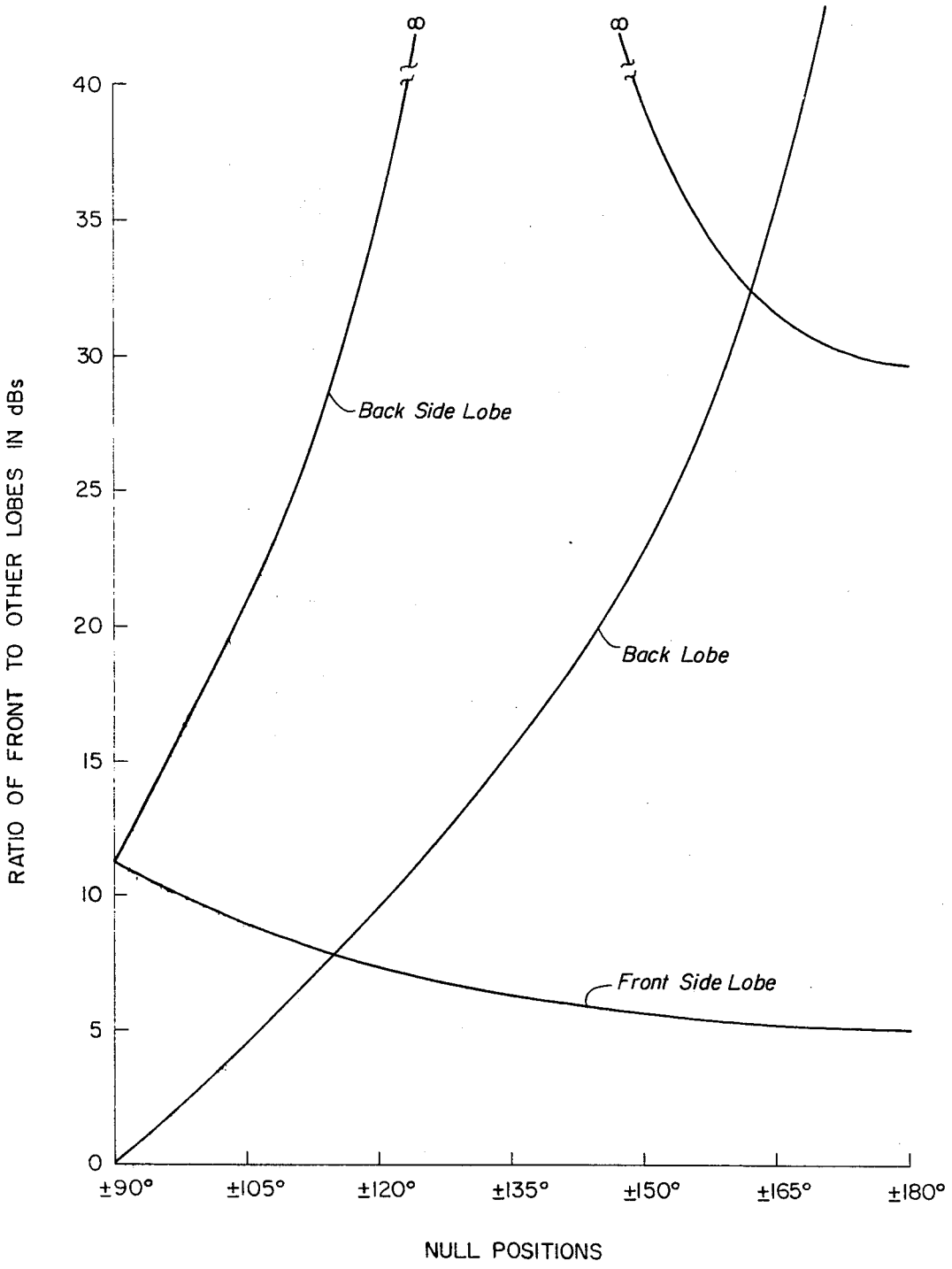
FIG. 3 is a plot of the front-to-side lobe ratios.

Equation (7) shows that the main lobe is at $\phi = 0°$ and the back lobe is at $\phi = 180°$. Equation (8) indicates two more symmetrical pairs of lobes which are called the front side lobes and back side lobes. Equation (8) is solved and plotted in FIG. 2. The variation in the back side lobe position is greater than that of the front side lobe. The amplitude of the side lobes can be computed now that their position is known. This is expressed as a front-to-side lobe ratio which is more significant for receiving antennas then just the lobe amplitude. The front-to-side lobe ratios plotted in FIG. 3 indicate that the back side lobes are quite small (large ratio) but the front side lobes are somewhat larger. The back lobe ($\phi = 180°$) is small for a large range of null positions. Another measure of the directivity is the beamwidth which is plotted in FIG. 4. The half power beamwidth varies only 2 degrees (41°—43°) over the full range of null positions. This is a very narrow beam and highly directive for an antenna that is only a very small fraction of a wavelength long. This is the same beamwidth one would expect from a broadside array one wavelength long.

Figure 5:
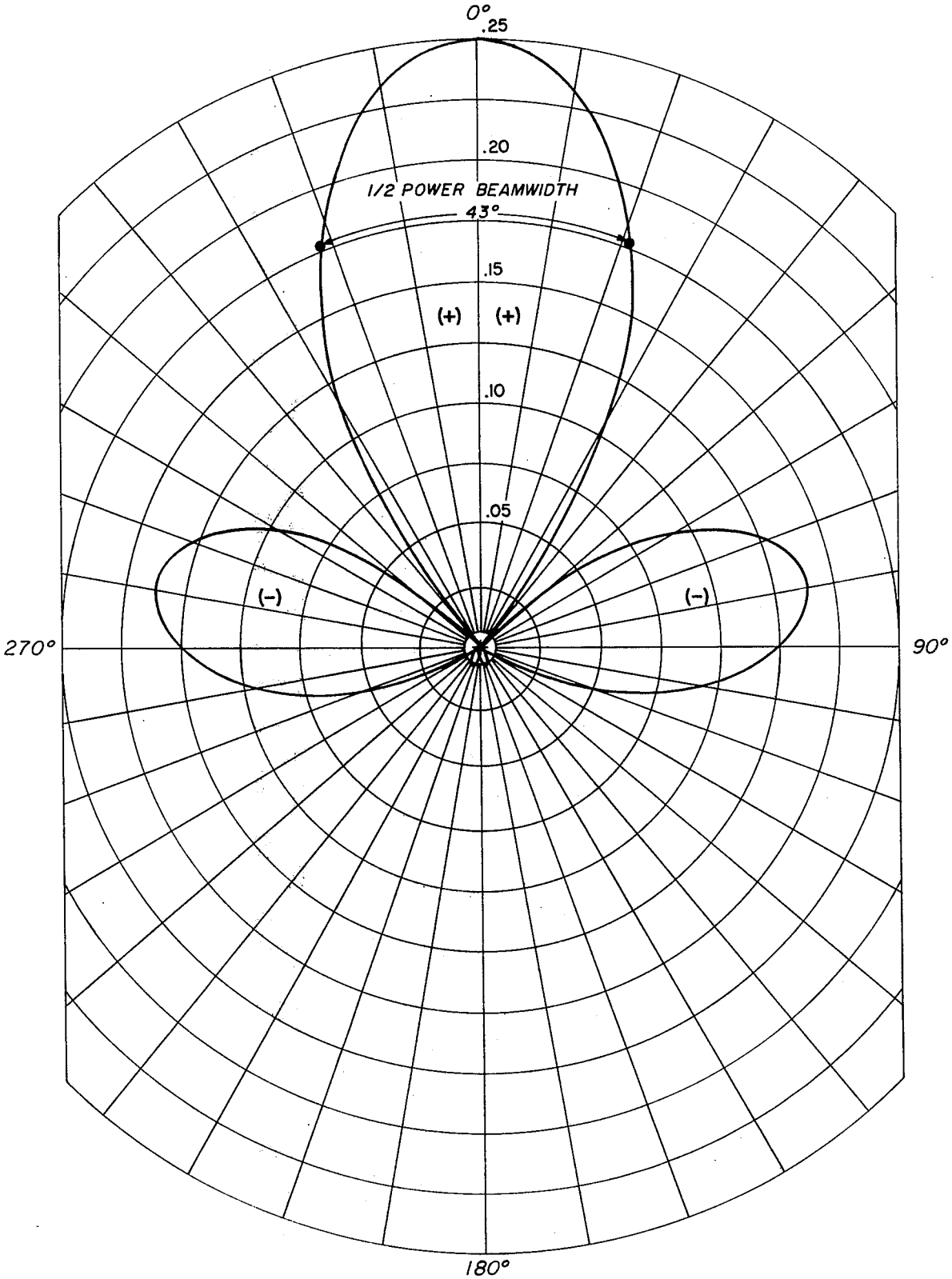
FIG. 5 is a plot of the reception pattern of the embodiment of FIG. 1.

FIG. 5 is the reception pattern of two pairs of coaxial loops of FIG. 1 with the null placed at $\phi = 180°$ and 0.08λ spacing between loops. All the lobe maximums and their amplitudes plus the nulls and the half-power points can be located from which the pattern can be sketched.

As long as the loop separation, D, is small ($D < 0.1\lambda$), a desirable condition, the distance between loops has very little effect on the shape of the pattern.

Obviously, many other modifications and variations of the present invention are possible in the light of the above teachings. It is therefore to be understood that within the scope of the appended claims the invention may be practiced otherwise than as aspecifically described.

What is claimed is:

1. An antenna system for receiving very low frequency communication signals having a narrow reception beamwidth with elements whose dimensions are a fraction of a wavelength comprising:

(a) first and second pairs of coaxial loop arrays dispersed with their axis parallel at 45° from the horizontal;

(b) each of said pairs of coaxial loop arrays being separated by less than a wavelength and connected so they are 180° out-of-phase; and (c) delay circuit means connecting said first and second pairs of coaxial loop arrays.

2. The antenna system of claim 1 wherein the separation of said loops and pairs of loops is less than 0.1λ.

3. The antenna system of claim 1 wherein the amount of delay is determined by where the null position is desired.

4. An antenna system for receiving very low frequency communication signal having a narrow reception beamwidth with elements whose dimensions are a fraction of a wavelength comprising:

(a) first and second pairs of coaxial loops;

(b) each pair of said loops being connected to receive signals 180° out of phase;

(c) each of said loops being positioned in parallel and at 45°; and (d) delay circuit means connecting said first and second pairs so that signals will be received and excluded in a predetermined pattern.

5. The antenna system of claim 4 wherein the distance between loops are substantially equal and less than 0.1λ.

* * * * *